US005664831A

United States Patent [19]

White et al.

[11] Patent Number: 5,664,831

[45] Date of Patent: Sep. 9, 1997

[54] SEMI-FITTED ONE-PIECE SLIPCOVER

[75] Inventors: Cecil A. White, New York, N.Y.; Susan Shaner, Easton, Pa.; Gretchen F. Dale, Westport, Conn.; Clarence J. Reiss, Jr., Walnut Port, Pa.

[73] Assignee: Fieldcrest Cannon, Inc., Eden, N.C.

[21] Appl. No.: 608,813

[22] Filed: Feb. 29, 1996

[51] Int. Cl.[6] ..... A47C 27/00

[52] U.S. Cl. ..... 297/225; 297/228.11

[58] Field of Search ..... 297/225, 224, 297/226, 228.11, 228.1, 229, 219.1, 218.1

[56] References Cited

U.S. PATENT DOCUMENTS

| | | | |
|---|---|---|---|
| Re. 24,279 | 2/1957 | Schutte et al. . | |
| 1,695,244 | 12/1928 | Cohen . | |
| 1,825,909 | 10/1931 | Levi . | |
| 2,183,828 | 12/1939 | Trubitz . | |
| 2,367,450 | 1/1945 | Trubitz . | |
| 2,667,211 | 1/1954 | Krasnov et al. . | |
| 2,793,683 | 5/1957 | Trubitt . | |
| 2,848,039 | 8/1958 | Lenz . | |
| 2,871,924 | 2/1959 | Trubitt | 297/228 |
| 2,884,993 | 5/1959 | Schutte . | |
| 4,838,610 | 6/1989 | Perrin . | |
| 5,320,407 | 6/1994 | Tell . | |
| 5,549,355 | 8/1996 | Illulian . | |

FOREIGN PATENT DOCUMENTS

| | | | |
|---|---|---|---|
| 2399223 | 4/1979 | France | 297/229 |
| 1300582 | 12/1972 | United Kingdom | 297/229 |

*Primary Examiner*—Milton Nelson, Jr.

*Attorney, Agent, or Firm*—Bell, Seltzer, Park & Gibson

[57] ABSTRACT

A semi-fitted, unitary slipcover for covering items of furniture have a base, back, arms, and a cushioned seat portion is described. The slipcover has a seat cushion covering portion which is surrounded by a cinching element for reducing its effective peripheral dimension, and specifically, for individually covering the seat portion of an item of furniture and defining the juncture between a lower edge of the seat portion and the furniture base. A main body portion of the slipcover is attached to the seat cushion covering portion along a first lengthwise side and includes first and second arm covering portions. The main body portion has a second lengthwise side which forms an open pouch; the main body portion is also surrounded by a cinching element for reducing its effective peripheral dimension, preferably along the same plane as that of the seat cushion covering portion. A skirt may also be secured to the front of the seat covering portion and the main body portion so that it extends downward from the cinching element to cover the base of the furniture.

24 Claims, 3 Drawing Sheets

SEMI-FITTED ONE-PIECE SLIPCOVER

BACKGROUND OF THE INVENTION

1. Field of the Invention

The present invention relates generally to a slipcover for a piece of upholstered seating-type furniture. More specifically, the invention relates to a semi-fitted, one-piece slipcover having a minimal number of parts and seams, for use on an item of furniture having a back and at least one seat cushion, which gives a neat appearance and which retains its position during use of the item of furniture.

2. Description of the Prior Art

Slipcovers for pieces of furniture are known in the art, and are frequently used by consumers to change the appearance of a piece of furniture. Such slipcovers are typically used to cover the piece of furniture with a different fabric, to cover damage such as holes or worn spots in the existing fabric of the furniture, or to hide the appearance of stains due to spills and the like. Such slipcovers historically have been custom-made to fit the item of furniture, and full-fashioned (i.e. fitted) in order that they provide the appearance of regular upholstered furniture, rather than a slipcovered appearance. Custom-making of slipcovers, however, tends to be time consuming and expensive; thus it often is more cost-effective to re-upholster the furniture than to slipcover it.

Prefabricated slipcovers which can fit a variety of furniture items of typical dimensions and which can be more readily applied by the consumer himself have also been developed. Though these slipcovers tend to be less expensive to produce than custom-tailored ones, they can be difficult to apply to some styles and shapes of furniture, and often result in an unsatisfactory appearance due to improper fit. Because of the desire to simplify the construction and application of such consumer-applied slipcovers, one-piece slipcovers have been developed.

Examples of such one-piece slipcovers are disclosed in U.S. Pat. No. 1,695,244 to Cohen, U.S. Pat. No. 4,838,610 to Perrin, and U.S. Pat. No. 5,320,407 to Tell. The patent to Cohen describes a one-piece slipcover which is full-fashioned to form a substantially fitted cover, and which includes extra lengths of material in certain areas in order that it can accommodate some variations in the furniture dimensions. The cover also includes an extra row of stitching along a front portion thereof in an attempt to give the appearance that the seat cushion has been separately covered. Because that portion of the slipcover which covers the base of the item of furniture hangs freely from the portion which covers the cushion front, a fitted appearance is not achieved by this cover. Further, when the seat cushion is compressed such as by a parcel being placed or a person sitting thereon, the front of the cover moves downwardly toward the floor in response to the cushion movement. Not only does this further destroy the illusion of the seat cushion being separately covered, but the-slipcover itself can be stepped on by the sitting person and become soiled or damaged.

The patent to Perrin describes a protective furniture cover which is formed to have dished portions which form arm-piece covers. The cover also includes a drawstring about its lower open end in order to enable it to be tightened about the base of the item of furniture which it covers. While providing a cover which is relatively easy to secure about the item of furniture, this cover provides a clearly slipcovered appearance to the furniture, as the cover extends freely downward from the top of the seat cushion. In other words, there is no means provided for delineating the seat cushion from the rest of the item of furniture being covered; therefore, the fact that the furniture has been slipcovered rather than re-upholstered is readily apparent. Further, because the cover is not secured about the seat cushion of the item of furniture, and particularly because it is not secured beneath the cushion about the cushion front, there is a greater tendency for the cover to become displaced in response to the typical movement caused by a person sitting down on and getting up from the item of furniture. In addition, because the front lower portion of the cover, i.e. the portion which covers the furniture base, extends downwardly from an upper edge of the seat cushions, the cover tends to balloon outwardly in response to compression of the seat cushion such as that caused by a person sitting in the sofa, which results in an undesirable appearance.

The patent to Tell describes a unitary adjustable cover which includes a plurality of panels which are joined together along a plurality of adjustable channels. The cover gives an obviously slipcovered appearance to the furniture being covered, particularly because the seat cushion(s) of the furniture is(are) covered unitarily with the rest of the furniture item and there is no means for delineating the cushions from the furniture base. Similar to the cover discussed in the Perrin patent, the cover has a tendency to become displaced as a result of the typical forces caused by a person sitting down on and getting up from the item of furniture being covered. Further, because the front of the cover extends freely downward from the top of the seat cushion, when the seat cushion is compressed such as by a parcel being placed or a person sitting thereon, the front of the cover moves downwardly along with the cushion movement. This tends to provide an undesirable appearance, particularly in the embodiment of the invention where the cover is secured about the bottom of the sofa, as the cover merely balloons outwardly from the seat to the floor. When the cover is not secured about the bottom of the piece of furniture, it tends to pool on the floor, where it can become soiled or damaged, particularly since the sagging material tends to be located in the same location as the seated person's feet. Further, a person's feet could become tangled in the sagging material, thereby causing the person to trip and fall.

In addition to the obvious practicability of slipcovers, the slip covered look for furniture has recent times become popular with interior designers and consumers alike. For this reason, it is sometimes preferred to have slipcovers which are "semi-fitted", meaning they are structured to some degree to correspond to the contours of the furniture which they cover, but are unstructured to a great enough extent that they still suggest a slipcovered appearance to observers. Heretofore, however, it has been difficult to achieve this semi-fitted look without the expensive customization process. Further, because designs of furniture vary so much from year to year and from manufacturer to manufacturer, it is difficult to obtain a consistently appealing fit on a variety of pieces of furniture from a single slipcover. For this reason, mass-produced, standardized slipcovers have been less commercially practicable than the obvious utility of such would suggest.

Thus, a need exists for a slipcover for furniture which can be readily manufactured using only a minimal number of pieces, and which is semi-fitted to provide a neat appearance, while suggesting the presence of a slipcover.

Further, a need exists for a slipcover which is can be easily applied by the consumer to pieces of furniture of various shapes and dimensions, without requiring full-fashioned customization.

In addition, a need exists for a slipcover which maintains its proper position and appearance on the item of furniture throughout use of the furniture and compression of the seat cushions thereof.

SUMMARY OF THE INVENTION

With the foregoing in mind, it is an object of the present invention to provide a unitary slipcover having only a minimal number of pieces and seams.

It is a further object of the invention to provide a slipcover which will provide an aesthetically appealing, semi-fitted appearance to a variety of shaped items of seating-type furniture, which can be readily and easily positioned on the item of furniture.

It is an additional object of the present invention to provide a slipcover which, when positioned on an item of furniture, maintains its proper position throughout normal use of the furniture, and which maintains an aesthetically pleasing appearance when the seat cushions of the furniture are compressed during use.

Other objects, features and advantages of the present invention will become apparent from the following detailed description when taken in conjunction with the accompanying drawings, in which like numerals indicate like elements.

The slipcover of the present invention is generally of a one-piece construction, and has a minimal number of seams and parts. The slipcover includes a first seat cushion covering portion which includes a cinching element which extends around its periphery, to provide a means for reducing the effective dimension thereof. In a preferred form of the invention, the cinching element is in the form of an elastic band which is in a stretched condition while it is secured to the periphery of the seat cushion covering portion. In this way, when the tension is released from the elastic band, the effective dimension of the seat cushion covering portion is reduced to form a substantially mushroom-shaped pouch.

A main body portion is desirably formed from a substantially rectangular shaped piece of material, which is folded lengthwise and seamed to itself at either end. A first lengthwise side of the main body portion is secured to the seat cushion covering portion while the second lengthwise side is left substantially free, in order to define an open pouch. This pouch formed by the main body portion is adapted to surround and cover the back of an item of furniture, with the seamed ends defining semi-fitted arm covering portions for the arms of the item of furniture. The main body portion is desirably sized so that it extends between about halfway and the entire way, and preferably about two-thirds of the way, around the perimeter of the seat cushion covering portion, to thereby encircle a major portion thereof.

The first lengthwise side of the main body portion is preferably secured to the seat cushion covering portion so that it is cinched along with the seat cushion covering portion, and a second cinching element is secured to the second lengthwise side to provide a means for tightening the main body portion around the back and arms of the item of furniture. The second cinching element is also desirably in the form of an elastic band which is secured to the second lengthwise side while it is in an extended condition, in order that it reduces the effective length of the side upon returning to its relaxed, unextended condition.

To provide a more aesthetically appealing appearance to an item of furniture covered by the slipcover, a skirt is desirably secured to the slipcover along the second lengthwise side of the main body portion and the portion of the periphery of the seat cushion covering portion which is not secured to the main body portion.

In operation, the slipcover is desirably positioned on an item of furniture so that the seat cushion covering portion surrounds the seat cushion(s) thereof in the manner of a shower cap positioned on a wearer's head. The cinching element surrounding the seat cushion covering portion preferably draws the periphery of the seat cushion covering portion into the crevices between the seat cushion and the base, back, and arms of the sofa. The cinching element extending along the second lengthwise side of the main body portion extends around the outside of the sofa back and arms, preferably in the same plane as the cinching element secured to the seat cushion covering portion. In this way, the separation between the seat cushion and the base is visibly delineated, and the skirt extends downward from beneath the seat cushion. As a result, a semi-fitted appearance is provided, the slipcover is maintained securely on the sofa, and its appearance remains relatively unchanged even when the seat cushions are compressed in response to a person sitting on the sofa.

DETAILED DESCRIPTION

Figure 1:
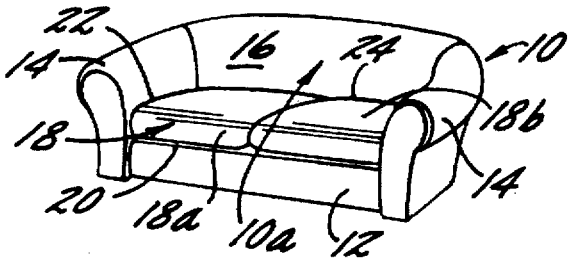
FIG. 1 is a perspective view of a front side of a conventional item of seating-type furniture, in the form of a sofa.
Figure 2:
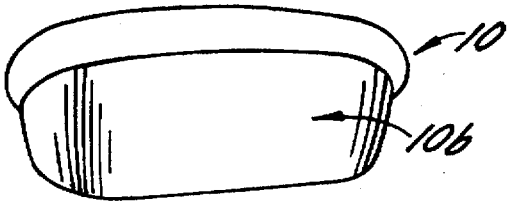
FIG. 2 is a view of the rear side of the item of seating-type furniture illustrated in FIG. 1.

With reference to the drawings, FIGS. 1 and illustrate a typical item of seating-type furniture 10, which for purposes of this example, is a seat in the form of a sofa. It will be noted, however, that slipcovers according to the present invention may be used in combination with any of a variety of types of seating-type furniture having a base, a back, and at least one seat cushion, e.g., club chairs, sofabeds, and the like. FIG. 1 illustrates the front side 10*a* (i.e. the seated side) of the sofa 10, while FIG. 2 illustrates the rear side 10*b* of the sofa. The sofa includes a seat base 12, which is typically somewhat rigid in order that it can support the rest of the furniture body and things which may be positioned thereon, such as a person (not shown). The base 12 can be of a variety of shapes, and may include supplemental legs (not shown) or the like.

The sofa 10 preferably includes first and second arms 14 which extend upwardly from opposite ends of the base 12, and are connected to each other by way of a sofa back 16. The back 16 is illustrated as being relatively smooth and continuous, though it is noted that any of a variety of shaped sofas could also be used in combination with a slipcover according to the instant invention. For example, the back 16 of the sofa 10 to be covered can be of the conventional camel back shape, or the like.

A cushioned region be extends substantially horizontally across the sofa base 12, to provide a sitting surface for a user of the sofa 10. In the illustrated embodiment, the cushioned region 18 includes first and second individual seat cushions 18*a*, 18*b*. It is noted, however, that items of furniture usable in combination with slipcovers of the present invention can include a single bench-style cushion or a plurality of cushions.

The cushioned region 18 (i.e. individual cushions 18*a*, 18*b*) are preferably at least partially separable from the seat base 12, in order that a crevice 20 is located between a lower front edge of the cushioned region and the seat base. A crevice 22 is also preferably located between the cushioned region 18 and each of the sofa arms 14, and a crevice 24 is desirably located between the cushioned region and the sofa back 16.

Figure 3:
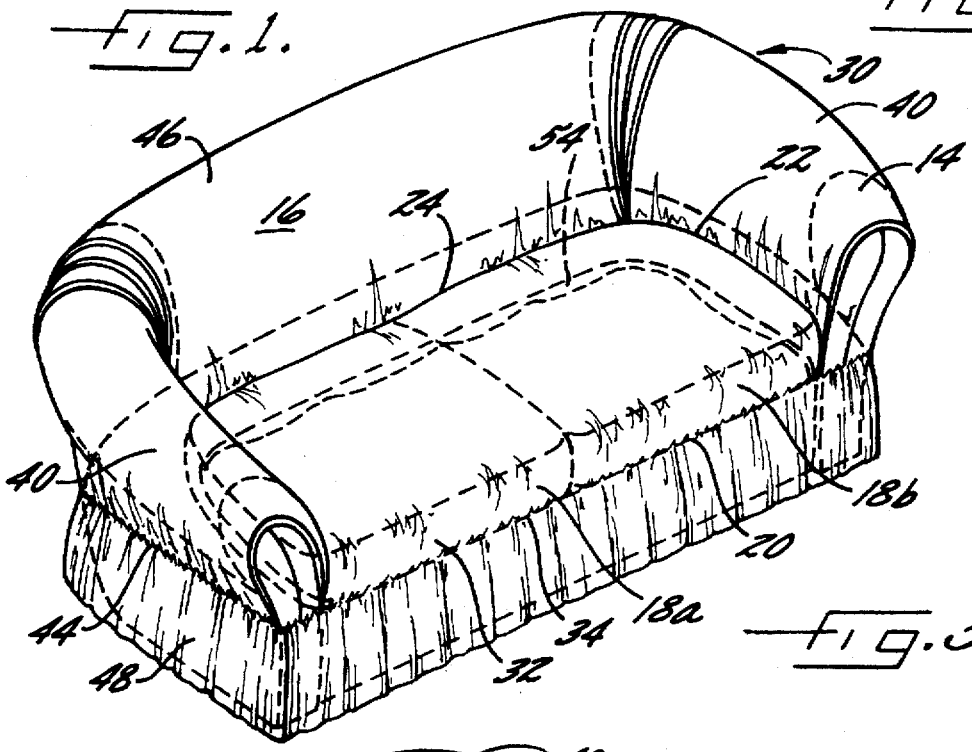
FIG. 3 is a birds-eye perspective view of the front side of the item of furniture illustrated in FIG. 1, having a slipcover according to the present invention positioned thereon.
Figure 4:
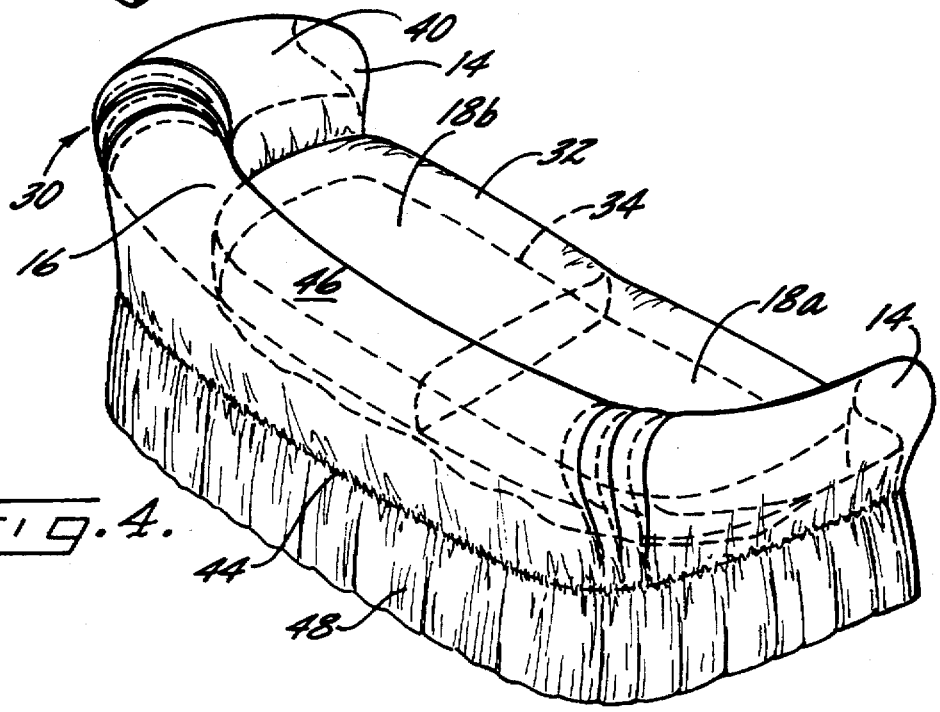
FIG. 4 is a birds-eye perspective view of the rear side of the item of furniture illustrated in FIG. 1 having a slipcover according to the present invention positioned thereon.
Figure 8:
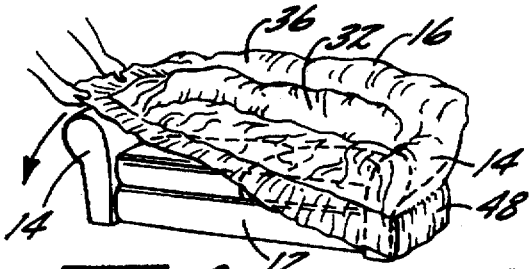
FIG. 8 is a perspective view of a front side of a piece of furniture as a slipcover according to the present invention is being positioned thereon.
Figure 9:
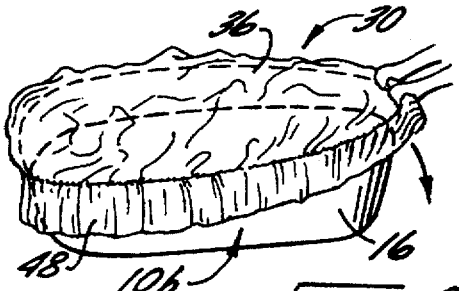
FIG. 9 is a perspective view of a rear side of an item of furniture as a slipcover according to the present invention is being positioned thereon.
Figure 5:
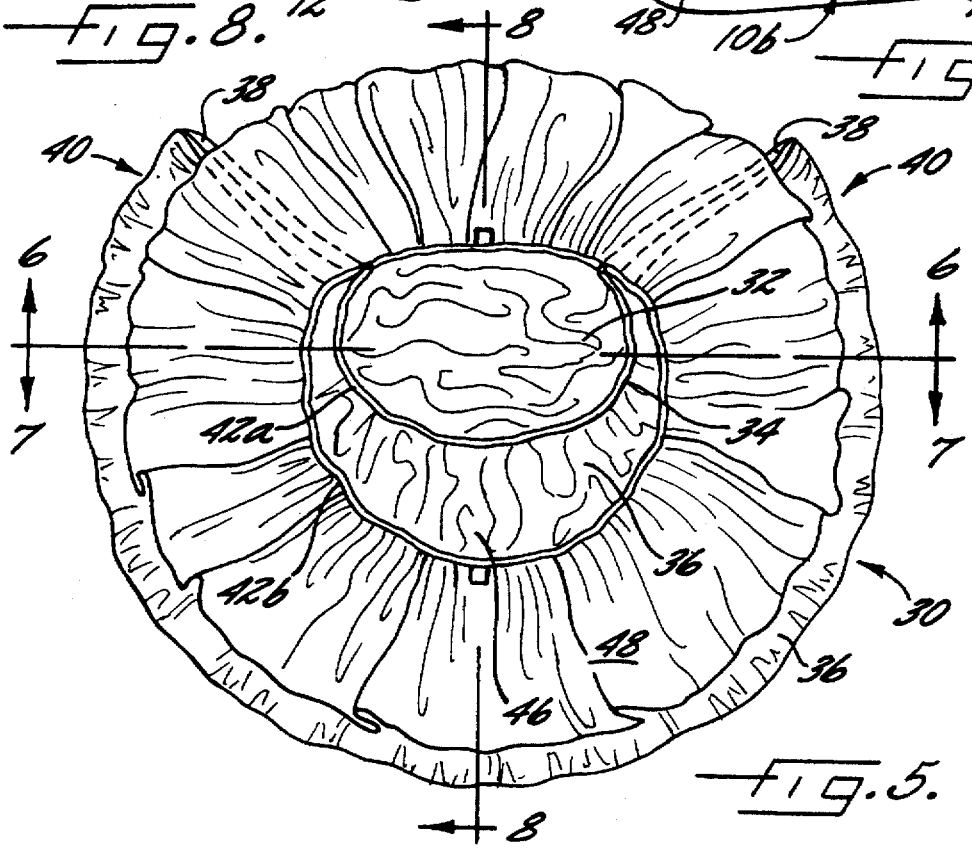
FIG. 5 is a plan view of a slipcover according to the present invention as it appears in a flattened condition prior to being positioned on an item of furniture.
Figure 6:
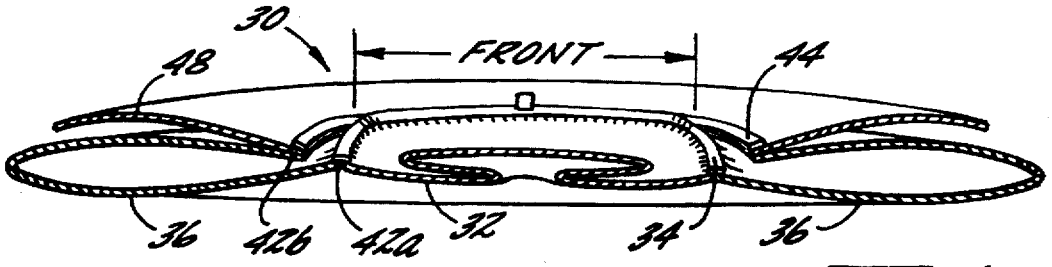
FIG. 6 is a cross-sectional view of a slipcover according to the present invention as shown along the lines 6—6 of FIG. 5.
Figure 7:
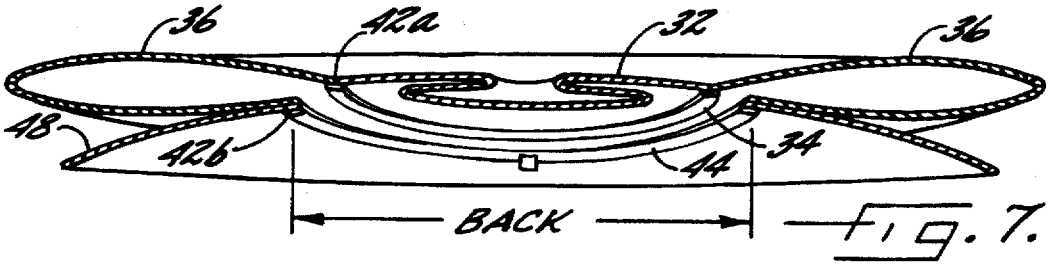
FIG. 7 is a cross-sectional view of a slipcover according to the present invention as shown along lines 7—7 of FIG. 5.

A slipcover according to the instant invention is shown generally at 30 in FIGS. 3–7, with FIGS. 3 and 4 illustrating the slipcover as it appears when positioned properly on the sofa 10 depicted in FIGS. 1 and 2. FIGS. 5–7 illustrate the slipcover 30 as it appears prior to being positioned on such an item of furniture 10.

The slipcover 30 is desirably of unitary construction and includes a seat cushion covering portion 32, which preferably is substantially oval or round. This seat cushion covering portion 32 is preferably formed from a body of material or fabric, and is substantially surrounded by a cinching element 34, which controls the effective peripheral dimension of the seat cushion covering portion. In a preferred form of the invention, the cinching element 34 is in the form of an elastic band which is secured to the periphery of the seat cushion covering portion 32 while the band is in an extended or stretched condition. In this way, when the band is allowed to relax and return to an unstretched condition, it cinches the periphery of the seat cushion covering portion 32 in a manner similar to a shower cap. Thus the seat cushion covering portion 32 has an expanse of material with a retracted peripheral dimension, thereby forming a three-dimensional mushroom-shaped pouch which can readily envelop a cushioned region 18 of a piece of furniture. While the preferred cinching element 34 is an elastic band, it is noted that other similar types of conventional cinching means such as drawstrings or the like can be used to reduce the effective periphery of the seat cushion covering portion 32, in order to secure it around a seat cushion in a manner discussed further herein.

A main body portion 36 of slipcover 30 is formed as a long, substantially rectangular piece of material which is folded lengthwise and secured to itself along seams 38 at either end. In a preferred form of the invention, the seams 38 are formed by sewing; however, other attachment means such as adhesive bonding or the like could be used. The seams 38 define arm covering portions 40 of the slipcover 30, as will be discussed further herein. The main body portion 36 is preferably inverted subsequent to the seaming step, in order that any seam allowance (not shown) formed at seams 38 will be located on the inside of the slipcover 30 when it is positioned on an item of furniture 10, to thereby provide a neater appearance.

A first lengthwise side 42*a* of the main body portion 36 is secured to the seat cushion covering portion 32 proximate its periphery such that the main body portion 36 extends greater than halfway but less than all of the way around the periphery of the seat cushion covering portion. In a preferred form of the invention, the main body portion 36 extends approximately two-thirds of the way around the periphery of the seat cushion covering portion 32. In a particularly preferred form of the invention, the first lengthwise side 42*a* of the main body portion 36 is joined to the seat cushion covering portion while the cinching element 34 is in its extended position so that upon release of the tension on the cinching element, the effective length of the first lengthwise side is effectively reduced due to gathering of the first lengthwise side material by the cinching element.

The second longitudinal side 42*b* of the main body 36 is preferably free (i.e. substantially unattached to the seat cushion covering portion 32), to form an open pouch with the first longitudinal side 42*a* and the arm covering portions 40 (i.e. the secured ends discussed above.) The second longitudinal side 42*b* preferably includes a cinching element 44 to enable a reduction of the effective length thereof. In a preferred form of the invention, the cinching element 44 is in the form of an elastic band which is secured to the second longitudinal side 42*b* while the band is in an extended condition; in this way, when the elastic band is allowed to return to its relaxed, unextended condition, it reduces the effective dimension of the second longitudinal side and gathers the material of the main body portion 36 therealong. In a preferred form of the invention, the cinching element 44 retracts to a lesser extent or is longer than cinching element 34, so that when each of the cinching elements is in a relaxed, substantially unstretched condition, a substantially open pocket is formed by the main body portion 36. Alternatively, the main body portion 36 may have an extended length proximate its longitudinal side 42*b*, again so that an open pocket is formed between the first and second longitudinal sides when the first longitudinal side is secured to the seat cushion covering portion 32.

In a preferred form of the invention, the substantially rectangular main body portion 36 has an increased width at least proximate one of its longitudinal sides, thereby providing a greater amount of material fullness proximate a middle region 46 of the folded main body, i.e. the region opposite that section of the seat cushion covering portion 32 which is not encircled by the first longitudinal side 42*a* of the main body. Because the main body portion 36 is adapted to cover at least the back 16, and preferably the back and arms 14 of a piece of furniture, the greater material fullness proximate the middle region 46 of the main body portion enables it to readily cover large, bulky items of furniture as well as less bulky items, since any excess slipcover material can be tucked away out of sight when the slipcover is in use, in the manner discussed further herein. Also, in order that first longitudinal side 42*a* of the main body portion 36 can be made to smoothly extend around the seat cushion covering portion 32, darts or pleats (not shown) can be provided in one or both of the portions, in a manner conventionally used to provide smooth joining of a relatively straight longitudinal piece of fabric to a curved one.

To provide a more finished look to the slipcover 30, a skirt 48 can be provided to a lower portion of the cover. The skirt 48 is preferably provided as a long rectangular piece of material or fabric which is secured about one of its longitudinal edges to the seat cushion covering and main body portions 32, 36 respectively, of the slipcover. As illustrated in FIG. 5, the skirt 48 has one of its longitudinal sides secured to the cinching element 44 secured to side 42*b* of the main body portion, and it continues around the front section of the seat cushion covering portion 32 which is not encircled by the main body portion 36, where it is preferably secured proximate cinching element 34. In one preferred form of the invention where it is desired that a gathered skirt be provided, the skirt 48 can be secured to the seat cushion covering portion 32 at the same time that cinching element 34 is secured thereto. The cinching element 34 in this form is desirably an elastic band, with the securement of the skirt 48, seat cushion covering portion 32, and cinching element preferably being accomplished while the cinching element is in a stretched condition. In this way, the skirt 48 is automatically gathered upon release of the tension stretching the elastic band. The securement of the skirt 48 to the main body portion 36 can be performed in the same manner, with the cinching element 44 being in the form of a stretched elastic band, in order that the portion of the skirt corresponding to the main body portion is also gathered.

As illustrated in FIGS. 3 and 4, when the slipcover 30 is properly positioned on an item of furniture 10, the substantially mushroom-shaped seat cushion covering portion 32 is positioned over the seat cushions 18*a*, 18*b* in the manner of a shower cap being secured over a wearer's hair. Because the cinching element 34 effectively reduces the periphery of the seat cushion covering portion 32, it has a natural tendency to withdraw beneath the seat cushions 18*a*, 18*b*, and into the crevices 20, 22, 24 between the cushion(s) and the rest of the furniture parts. Because the cinching element 34 cinches the seat cushion covering portion 32 beneath the seat cushion(s) 18*a*, 18*b* of the item of furniture, the seat cushion is securely and neatly covered by the slipcover 30. Further, because the slipcover is drawn into the crevice 20 between the seat cushion portion 18 and the base, the division therebetween is naturally delineated, thereby providing a semi-fitted appearance. The main body portion 36 preferably covers the back 16 of the sofa 10, and cinching element 44 extends around the outer side of the item of furniture 10 to secure this portion of the slipcover 30 thereon. Where the slipcover 30 is used to cover a sofa 10 having arms 14, the main body portion also desirably covers the arms and the cinching element 44 extends around the back 16 and arms 14 at a position substantially parallel with the floor or other surface on which the item of furniture sits. The main body portion 36 of the slipcover 30 preferably terminates proximate the arms 14 of the sofa 10, and the skirt 48 extends downwardly from beneath the seat cushion 18 and cinching element 44 toward the floor. Because the skirt 48 extends from beneath the cushioned portion 18 of the sofa 10 rather than from above it in the manner of many prior art slipcover constructions, the positioning and appearance of the skirt remains relatively unaffected throughout compression of the cushion, such as that which would be caused by a person sitting on the sofa.

With reference to FIGS. 8–16, positioning of the slipcover 30 on an item of furniture 10 is performed as follows. Beginning from a side of the sofa 10, for example, the slipcover 30 is positioned so that one of the arm covering portions 40 is positioned over one of the arms 14 of the sofa. The slipcover 30 is then extended across the piece of furniture so that the back 16 of the sofa is covered by the main body portion 36 of the slipcover, and the seat cushion covering portion 32 extends over the seat cushion region 18 of the piece of furniture. The second of the arm covering portions 40 is then positioned over the second arm 14 of the sofa. The peripheral dimension of the seat cushion covering portion 32 is expanded, such as by stretching the cinching means 34, and the seat cushion covering portion is positioned over the seat cushion(S) 18*a*, 18*b* of the sofa 10, preferably such that the seat cushion covering portion extends into the crevices 20, 22 and 24 between the seat cushion(s) and the sofa base, arms, and back, respectively.

Figure 10:
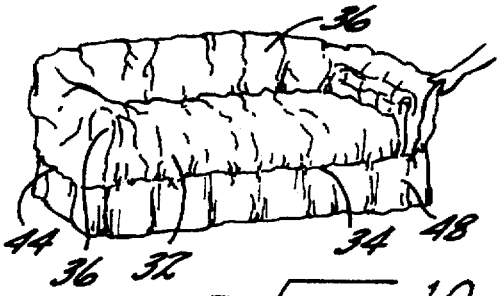
FIG. 10 is a perspective view of a front side of an item of furniture with a slipcover according to the present invention positioned thereon and as it appears prior to the tucking in of excess slipcover fabric.
Figure 11:
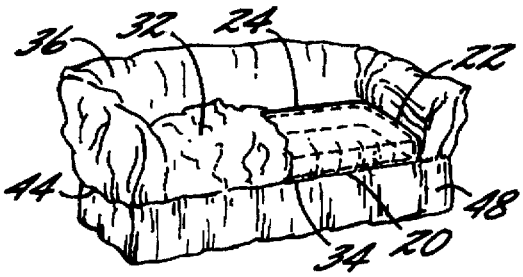
FIG. 11 is a partial sectional view illustrating the position of the seat cushions with respect to a slipcover positioned on the item of furniture after a portion of the excess slipcover fabric is tucked in about the cushions.

The main body portion 36 is desirably pulled downwardly to straighten it and so that the cinching element 44 extends substantially parallel to the floor, and in substantially in the same plane as the cinching element 34. As shown in FIG. 10, the slipcover typically fits somewhat loosely on the item of furniture at this point.

As discussed above, and particularly where the cinching element 34 is in the form of an elastic band, the retraction of the band after it is stretched to extend over the seat cushions 18*a*, 18*b* naturally tends to pull the seat cushion covering portion 32 somewhat taut over the cushions, and to bias the adjustment means within the aforementioned crevices in the sofa. However, the user can tuck any excess material which may exist in regions of the slipcover 30 proximate the cinching element 34 into the crevices 20, 22, and 24 between the seat cushions and the base, arms and back, respectively until the slipcover material on the seat cushion(s) is relatively smooth.

Figure 12:
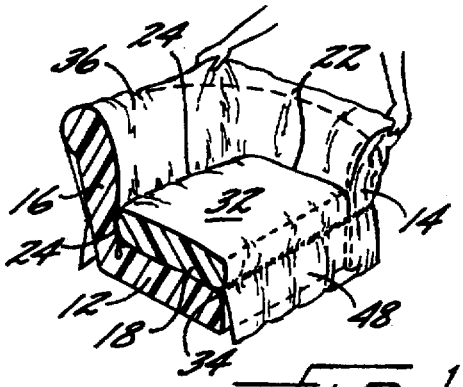
FIG. 12 is a sectional view of an item of furniture as it appears with a slipcover according to the present invention being positioned thereon as the slipcover fabric is being straightened about the furniture arm and back.
Figure 13:
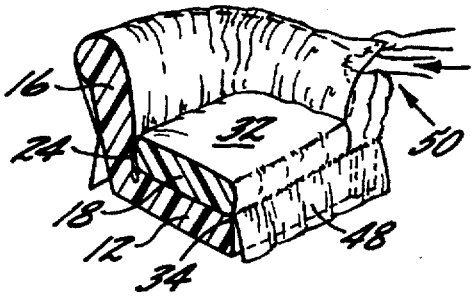
FIG. 13 is a sectional view of an item of furniture as it appears with a slipcover according to the present invention positioned thereon and as the slipcover is being underlapped proximate the furniture arms.
Figure 14:
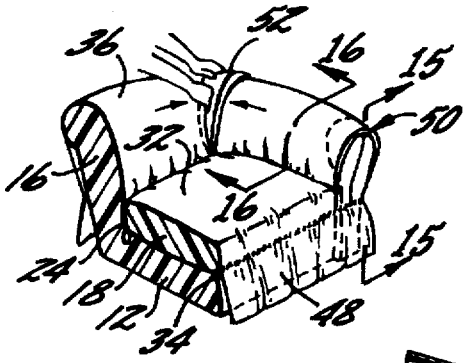
FIG. 14 is a sectional view of an item of furniture as it appears with a slipcover according to the present invention being positioned thereon and while excess slipcover material is being pleated about the juncture of the furniture arm and back.
Figure 15:
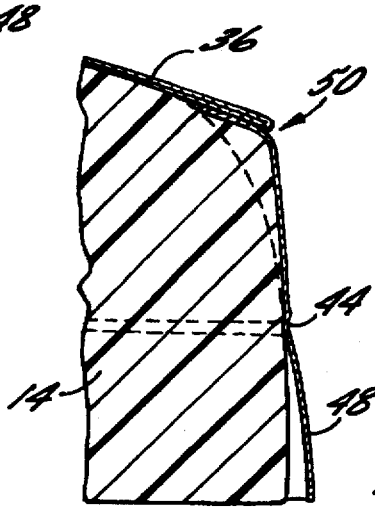
FIG. 15 is a cross-sectional view taken along line 15—15 of FIG. 14, illustrating the underlapping of the slipcover material proximate the furniture arm.
Figure 16:
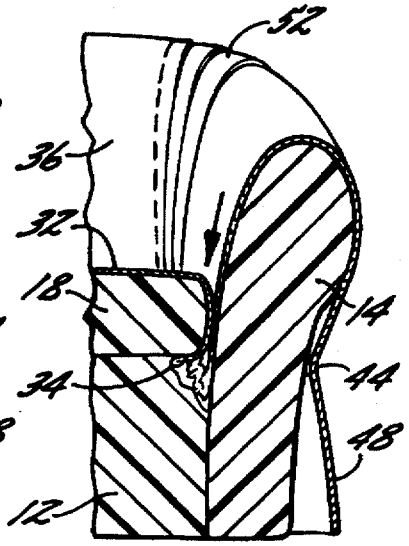
FIG. 16 illustrates a cross-section view taken along line 16—16 of FIG. 14, illustrating the excess slipcover material tucked into the crevice between the seat cushion and the furniture arm.

As shown in FIG. 12, the user then straightens the slipcover material about the sofa arms, then underlaps any excess at the front of the sofa arms 14 in the manner illustrated in FIG. 13 at 50. The seams 38 are preferably centered about the front of the sofa arms 14 to provide a neat appearance, with the excess fabric being underlapped neatly in the form of an inverted pleat.

If any excess material remains proximate the juncture of the sofa arms 14 and back 16, it may easily be underlapped to form a series of pleats 52. Additionally, because the cinching element 34 is located beneath the seat cushion region 18 and defines the upper edge of the portion of the slipcover covering the seat base 12, the position of the slipcover remains substantially the same even when the seat cushions are compressed. Thus, the semi-fitted appearance of the slipcover is maintained throughout the various stages of use of the sofa, and the problems associated with prior art slipcovers are overcome.

The slipcover 30 can be made from any of a variety of materials or fabrics, such as typical upholstery-type fabrics or plastic materials. The cinching elements 34, 44 can be secured to the seat cushion covering portion, main body portion, and skirt using any conventional securement methods, such as sewing, adhesive bonding, or the like. Where the slipcover 30 is formed from a thermoplastic material, the cinching elements could be ultrasonically welded to the slipcover portions, in a known manner.

Further, it is noted that the cinching elements 34, 44, which have been illustrated as being provided as two individual pieces, could be provided as one single piece of band material, or numerous pieces, according to the desires of the manufacturer.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. A slipcover for a piece of furniture having a back, arms and at least one seat cushion, said slipcover comprising:

a pouch-like seat cushion covering portion including a circumference adjusting member for varying a peripheral dimension thereof, and a pouch-like main body portion for covering the back and arms of the piece of furniture, said main body portion having a perimeter adjusting member extending about its periphery for varying the effective peripheral dimension thereof, at least a section of said circumference adjusting member of the seat covering portion being coextensive with a section of the perimeter adjusting member of the main body portion such that said main body portion substantially encircles a major portion of the circumference of the seat covering portion.

2. The slipcover according to claim 1, wherein said circumference adjusting member comprises an elastic band secured to the periphery of the seat cushion covering portion.

3. The slipcover according to claim 2, wherein said elastic band is secured while in a stretched configuration such that the peripheral dimension of the seat cushion covering portion is effectively reduced when the elastic band assumes a relaxed state.

4. The slipcover according to claim 1, wherein said perimeter adjusting member comprises an elastic band secured to the periphery of the main body portion.

5. The slipcover according to claim 4, wherein said elastic band is secured while in a stretched configuration such that the peripheral dimension of the main body portion is effectively reduced when the elastic band assumes a relaxed state.

6. The slipcover according to claim 1, further comprising a skirt portion secured to the seat covering portion and the main body portion proximate portions of their respective peripheries where the sections of said circumference adjusting member and said perimeter adjusting member are not coextensive with each other.

7. The slipcover according to claim 1, wherein said main body portion terminates in first and second ends, said ends defining semi-fitted arm portions for neatly conforming to the arms of the piece of furniture.

8. A sofa and slipcover combination comprising:

a sofa including a base, a back, first and second arms, and at least one seat cushion, and a unitary slipcover positioned on the sofa and covering at least the back, arms, and at least one seat cushion thereof, said slipcover including a first cinching element for securing the slipcover about the seat cushion of the sofa such that a portion of the slipcover extends beneath a front portion of the seat cushion remote from the sofa back to thereby delineate the seat cushion from the rest of the sofa and provide a semi-fitted appearance to the slipcovered sofa, and further comprising a second cinching element secured to the slipcover and extending about the arms and back of said sofa in substantially the same plane as said first cinching element to further secure the slipcover to the sofa.

9. The sofa and slipcover combination according to claim 8, further comprising crevices between the seat cushion and back and arms of the sofa, and wherein said slipcover extends into the crevices, to provide a fitted appearance to the entire seat cushion of the sofa.

10. A one-piece slipcover for covering a sofa having a back, arms and at least one seat cushion, said slipcover comprising a first pouch for covering back and arms of a sofa, a second pouch secured to the first pouch for covering a seat cushion of a sofa, and a first cinching element for cinching the second pouch beneath a seat cushion of a sofa, and a second cinching element secured to the slipcover and adapted to extend about the arms and back of the sofa in substantially the same plane as said first cinching element to secure the slipcover to the sofa and to thereby provide a semi-fitted appearance to the slipcovered sofa.

11. A semi-fitted one-piece slipcover for covering a piece of furniture having a base, back, arms, and at least one seat cushion positioned on the base, said slipcover comprising:

a main body portion for covering the back of the piece of furniture and terminating at first and second ends in shaped arm covering portions for covering the arms of the piece of furniture, a seat cushion covering portion secured to the main body portion and including a first cinching member for biasing a peripheral portion of the seat cushion covering portion beneath a seat cushion of the piece of furniture, a second cinching member extending about the periphery of said main body portion, said cinching member being adapted to extend around the arms and back of the piece of furniture in substantially the same plane as said first cinching member when the first cinching member is positioned beneath the seat cushion of the piece of furniture, and a skirt having a first section secured to the seat cushion covering portion, for covering at least a portion of the base of the piece of furniture extending from the seat cushion toward a lower surface of the piece of furniture, to thereby provide a semi-fitted appearance thereto.

12. A slipcover according to claim 11, wherein a second section of said skirt is secured to the main body portion, and is adapted to extend around substantially the entire base of the piece of furniture.

13. A slipcover according to claim 11, wherein said first cinching member comprises an elastic band.

14. A one-piece slipcover adapted to cover the back, arms and seat cushion of a sofa, said slipcover including a main body portion for covering a back and a pair of arms of the sofa, a seat cushion covering portion for covering the seat cushion of the sofa, and means for biasing the slipcover substantially directly beneath a lower edge of a front portion of a seat cushion, wherein said means for biasing the slipcover beneath a lower edge of a front portion of a seat cushion comprises a cinching element secured to said main body and seat cushion covering portions for extending circumferentially around the sofa in a spaced relationship to a lower edge thereof, said cinching element being adapted to gather the slipcover beneath the seat cushion to provide a semi-fitted appearance thereto.

15. A one-piece slipcover for a sofa having a back, a pair of arms, and a seat cushion, said slipcover comprising:

a main body portion for covering the back and the pair of arms of the sofa, a seat cushion covering portion for covering the seat cushion of the sofa, and a cinching element secured to said main body and seat cushion covering portions for extending circumferentially around the sofa in a spaced relationship to a lower edge thereof, said cinching element being adapted to gather the slipcover beneath the seat cushion to provide a semi-fitted appearance thereto.

16. The slipcover according to claim 15, further comprising a skirt secured to peripheral portions of said main body and seat cushion covering portions, said skirt being adapted to extend downwardly from said cinching element to cover a base portion of the sofa.

17. A one-piece slipcover and sofa combination comprising:

a sofa including a back, a pair of arms, a base, and at least one seat cushion positioned on the base, and a slipcover, said slipcover including a skirt extending from proximate the base of the sofa to proximate a lower edge of a seat cushion thereof and extending circumferentially about said base, said skirt including a cinching element extending substantially continuously along its upper end for tightening the skirt around the base and the back of the sofa, said cinching element extending substantially parallel to a lower edge of the skirt, and said slipcover further including a seat cushion covering pouch secured to a front section of the cinching element and covering the seat cushion of the sofa, and a main body pouch secured to a rear section of the cinching element and covering the back and arms of the sofa, to thereby define a semi-fitted slipcover.

18. The slipcover and sofa combination according to claim 17, wherein said cinching element comprises an elastic band secured to the skirt.

19. The slipcover and sofa combination according to claim 18, wherein said elastic band is secured while in a stretched configuration such that a peripheral dimension of the seat cushion covering portion is effectively reduced when the elastic band assumes a relaxed state.

20. The slipcover and sofa combination according to claim 17, wherein said seat cushion covering pouch extends into crevices formed at junctions of said at least one seat cushion and back and arms of the sofa.

21. The slipcover and sofa combination according to claim 20, further comprising a second cinching element secured to a portion of the seat cushion covering pouch which extends into said crevices to secure the seat cushion covering pouch therein.

22. A slipcover comprising a first substantially mushroom-shaped seat cushion covering portion for enveloping a seat cushion of a sofa and extending beneath a front portion thereof, said seat cushion covering portion including a cinching element extending about at least front and rear portions of said seat cushion covering portion for tightening the seat cushion covering portion about the seat cushion, and a substantially rectangular main body portion, said main body portion being folded longitudinally and secured together at its respective ends to define first and second arm covering portions, and including first and second longitudinal edges, said first longitudinal edge being secured to the seat cushion covering portion to encircle a major portion thereof, and said second longitudinal edge being substantially free to define an open pouch with said arm covering portions and first longitudinal edge for receiving a back and a pair of arms of a sofa, and further comprising a second cinching element secured about said second longitudinal edge of said main body portion, said second cinching element being adapted to extend around the arms and back of the sofa in substantially the same plane as said first cinching element when the first cinching element is positioned beneath the seat cushion of the sofa, and to enable the main body to be tightened about the back and the pair of arms of the sofa.

23. A slipcover according to claim 22, further comprising a skirt having a first section secured to the portion of the seat cushion covering portion adapted to extend beneath the seat cushion and a second section secured to said second cinching element, said skirt being adapted to cover a base portion of a sofa.

24. A one-piece slipcover for covering a sofa having a back, arms, base and seat cushion, said slipcover comprising a body of material defining a main body portion for covering at least the back and arms of the sofa and a seat cushion covering portion for covering the seat cushion of the sofa, a first cinching element secured to and extending substantially across the width of the seat cushion covering portion to cinch the peripheral dimension thereof and bias the seat cushion covering portion substantially beneath a front portion of the seat cushion of the sofa, a second cinching element secured to and extending circumferentially around a portion of the periphery of the seat cushion covering portion not secured to said first cinching element, and a third cinching element secured to and extending circumferentially around the periphery of the main body portion, to enable the slipcover to be readily tightened about the sofa.

* * * * *